US006616239B2

(12) United States Patent
Guillot

(10) Patent No.: US 6,616,239 B2
(45) Date of Patent: Sep. 9, 2003

(54) RAIL CLIP FOR SEAT BASES

(75) Inventor: Edmond P. Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 09/836,948

(22) Filed: Apr. 18, 2001

(65) Prior Publication Data

US 2002/0153759 A1 Oct. 24, 2002

(51) Int. Cl.[7] ..... A47C 7/02
(52) U.S. Cl. ..... 297/452.54; 267/81; 297/452.52
(58) Field of Search ..... 297/452.52, 452.54, 297/452.49, 452.5, 452.18, 218.5, 218.1, 219.1, 440.22, 463.1; 267/81, 105, 106, 110; 5/255, 264.1, 263, 247

(56) References Cited

U.S. PATENT DOCUMENTS

| | | | | |
|---|---|---|---|---|
| 2,177,363 | A | * | 10/1939 | Flint |
| 2,311,145 | A | * | 2/1943 | Widman |
| 2,593,831 | A | * | 4/1952 | Bank |
| 2,613,734 | A | | 10/1952 | Hopkes |
| 2,685,330 | A | | 8/1954 | Handren, Jr. et al. |
| 2,716,442 | A | | 8/1955 | Larson et al. |
| 3,213,977 | A | | 10/1965 | Baritz |
| 3,276,801 | A | | 10/1966 | Jones |
| 3,338,572 | A | | 8/1967 | Schutz et al. |
| 3,422,468 | A | | 1/1969 | Schutz |
| 3,519,261 | A | | 7/1970 | Surletta et al. |
| 3,522,646 | A | | 8/1970 | Sibthorp |
| 3,551,282 | A | | 12/1970 | Hogue |
| 3,649,077 | A | * | 3/1972 | Flint |
| 3,720,960 | A | | 3/1973 | Bond |
| 3,773,310 | A | | 11/1973 | Crosby |
| 3,791,749 | A | | 2/1974 | Grille et al. |
| 3,858,858 | A | | 1/1975 | Higbea |
| 3,891,198 | A | | 6/1975 | Bible |
| 3,969,793 | A | | 7/1976 | Crosby |
| 3,992,853 | A | | 11/1976 | Morris |
| 4,037,829 | A | | 7/1977 | Crosby et al. |
| 4,062,087 | A | | 12/1977 | Lingle |
| 4,102,586 | A | | 7/1978 | Pearson et al. |
| 4,153,959 | A | | 5/1979 | Omley |
| 4,157,172 | A | | 6/1979 | Crosby |
| 4,157,173 | A | | 6/1979 | Crosby |
| 4,189,523 | A | | 2/1980 | Pearson |
| 4,209,198 | A | * | 6/1980 | Apple, Sr. |
| 4,228,991 | A | | 10/1980 | Crosby |
| RE30,941 | E | | 5/1982 | Crosby |
| 4,364,547 | A | | 12/1982 | Crosby |

(List continued on next page.)

OTHER PUBLICATIONS

Advertisement; Enduroflex; Hickory Springs Mfg. Co.; 1994.

*Primary Examiner*—Peter M. Cuomo
*Assistant Examiner*—Stephen Vu
(74) *Attorney, Agent, or Firm*—Alston & Bird LLP

(57) ABSTRACT

A monolithic rail clip, formed from a single piece of material, comprises a plurality of integrated hooks spaced along an angled rail body for use in constructing a seat base. A pair of the rail clips are attached to a pair of opposing members of a frame of the seat base so that the integrated hooks form opposing pairs. A plurality of springs are attached to the hook pairs and stretch between the opposing members to define a resilient structure for supporting a furniture seat. Each rail clip is constructed by forming a plurality of tabs extending from one longitudinal edge of the rail body and bending the tabs to form the plurality of hooks. The integral construction of the hooks reduces the assembly time of each rail and seat base. The monolithic construction of the rail clip provides additional structural rigidity to the seat base.

7 Claims, 3 Drawing Sheets

U.S. PATENT DOCUMENTS 4,454,636 A 6/1984 Pearson
4,586,700 A 5/1986 Crosby
4,715,587 A 12/1987 Grosby
4,815,717 A 3/1989 Crosby
4,935,998 A 6/1990 Frazier et al.
5,346,285 A 9/1994 West, III
5,409,198 A 4/1995 Roick
5,538,325 A * 7/1996 Bullard ..... 297/440.22
5,542,775 A 8/1996 Bechtoldt et al.
5,601,333 A * 2/1997 Bostrom et al.
5,722,131 A 3/1998 Leistner et al.
5,833,064 A 11/1998 Ayres et al.
6,055,716 A 5/2000 Ayres et al.
6,170,915 B1 * 1/2001 Weisz ..... 297/452.5

* cited by examiner

RAIL CLIP FOR SEAT BASES

FIELD OF THE INVENTION

The present invention relates to the field of furniture and furniture construction, more particularly to the construction of flexible seat bases for sofas, couches and the like.

BACKGROUND OF THE INVENTION

Luxury chairs, sofas, and loveseats are well known in the art and have become a mainstay in many households. These types of furniture typically comprise a wood or metal frame defining a main seating area, an upright portion for cushioning a user's back, and two armrests. A plurality of sinuous wires typically extend across the main seating area upon which a seat cushion is positioned for providing a cushioning and comfortable seating area. In particular, sinuous wires allow the main seating area to flex and thus shape to the form of the user sitting in the chair.

In one conventional design, the main seating area includes a pair of angle irons secured to the wood frame for attaching the sinuous wires. In particular, the angle irons define slots for receiving clips that include a hook portion on one end for engaging the sinuous wires. In operation, each clip is slidably mounted through one of the slots in the angle iron, and the wires are then stretched over the hook of the remaining end of the clip such that the clip is put in a state of tension. This state of tension secures the sinuous wires across the main seating area. The clips, however, are susceptible to becoming dislodged from the slots, especially if upward tension is applied to the wires and the clips by lifting the seat from the bottom.

Another conventional design provides a plurality of metal clips that attach to the wood frame of the main seating area. The clips are individually attached to the wood frame by screws, nails, or integrated anchor tangs extending from the clip. However, each clip must be aligned in relation to the other clips and secured to the frame, which increases assembly time. Moreover, the clips are usually cut from a larger piece of metal, which increases manufacturing costs.

U.S. Pat. No. 5,346,285 to West discloses a structurally reinforced furniture frame for a sofa or a chair. The furniture is reinforced using a metallic frame which provides a rigid frame and supports the spring decking upon which furniture cushions rest. The individual springs that comprise the spring decking are attached to a plurality of elongated hooks. The elongated hooks are formed by punching thin gauge metallic material to form spaced 1 inch protrusions and then welding the metallic material to the metallic frame.

It would be desirable to have a reinforcing frame that is easily constructed and provides for the quick and firm attachment of springs to form a support for articles of furniture and furniture cushioning.

SUMMARY OF THE INVENTION

The present invention addresses the above needs and achieves other advantages by providing a rail clip, comprising an elongated rail that supports a plurality of hooks configured to hold a plurality of springs in a seat base, wherein the rail and hooks are constructed from a single metal piece, also referred to herein as a monolithic construction. The monolithic construction of the rail clip allows for the quick installation of the hooks in the seat base by eliminating the need to position and attach each hook individually. In addition, the hooks are configured to firmly receive and hold the plurality of springs during everyday repetitive loading and unloading of the furniture seat.

In one embodiment, the present invention includes a seat base having a pair of rail clips installed therein. The seat base includes a frame that has a first frame member spaced apart from a second frame member. The seat base also includes a first elongate rail attached to the first frame member and a second elongate rail attached to the second frame member. Spaced along each elongate rail is a plurality of hooks that are integrally formed on the elongate rail. The seat base further includes a plurality of springs each having first and second ends. The first end of each spring is attached to one of the integrated hooks on the first elongate rail, while the second end of the spring is attached to one of the integrated hooks on the second elongate rail. The springs are attached so that they stretch between the opposing first and second members to define a resilient structure for supporting the furniture seat, wherein each elongate rail and the hooks formed thereon comprise a monolithic structure formed from a single piece of material.

The plurality of hooks can be spaced at intervals along each elongate rail such that the attached springs are spaced at equidistant intervals. Spacing the springs at equidistant intervals provides uniform support for a furniture seat placed thereon. In another aspect, noise suppressing material (e.g., a tape) can be applied to the spring-engaging surfaces of each of the integrated hooks. The noise suppressing material reduces the squeaking that occurs due to relative motion of the spring and hooks during loading and unloading of the seat base.

Preferably, the rail clip is constructed from an elongate rail formed of a metal sheet. A plurality of tabs are cut or otherwise formed from the metal sheet and extend from one longitudinal edge of the rail. The tabs comprise integral extensions of the metal sheet spaced apart along the edge of the rail. The hooks are formed by bending the tabs out of the plane of the elongate rail. Each hook is configured to receive and firmly hold an end of a wire spring.

The furniture seat and rail clip of the present invention has several advantages. The hooks and the rail comprise a monolithic structure formed from a single piece of material, eliminating the step of assembling the rail clip before installation. In addition, the integral construction of the hooks eliminates the need to install and space each hook individually along the rail clip, or the frame of the seat base. The hooks have greater strength and are not susceptible to being dislodged and falling out like some conventional hooks, even when the seat is picked up from below. Once installed in the seat base, the rail clip provides additional reinforcement to the frame resulting in a more rigid seat base. Alternatively, the additional reinforcement provided by the rail clip can allow a reduction in thickness of the wood parts of the seat base without sacrificing strength.

BRIEF DESCRIPTION OF THE DRAWINGS

Figure 1:
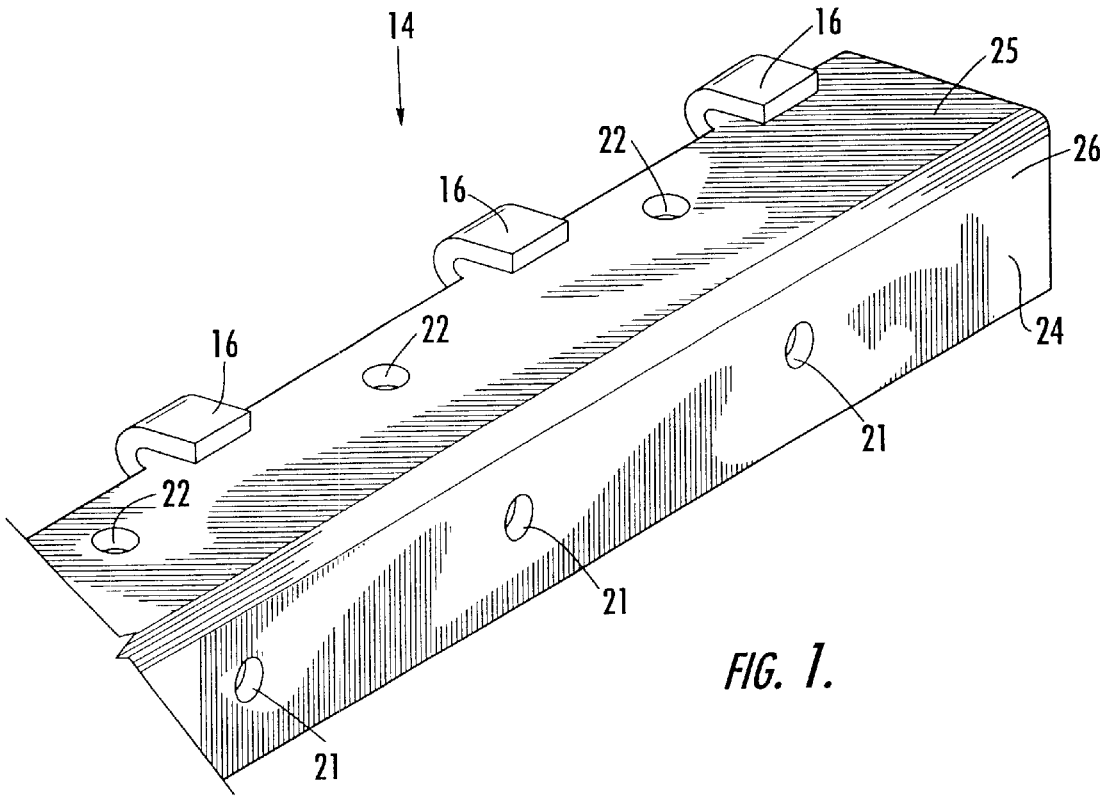
Figure 2:
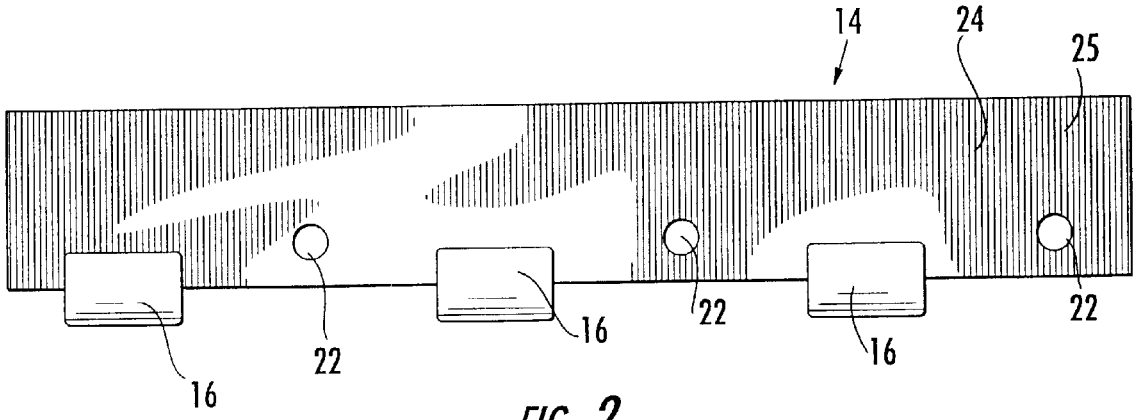
Figure 3:
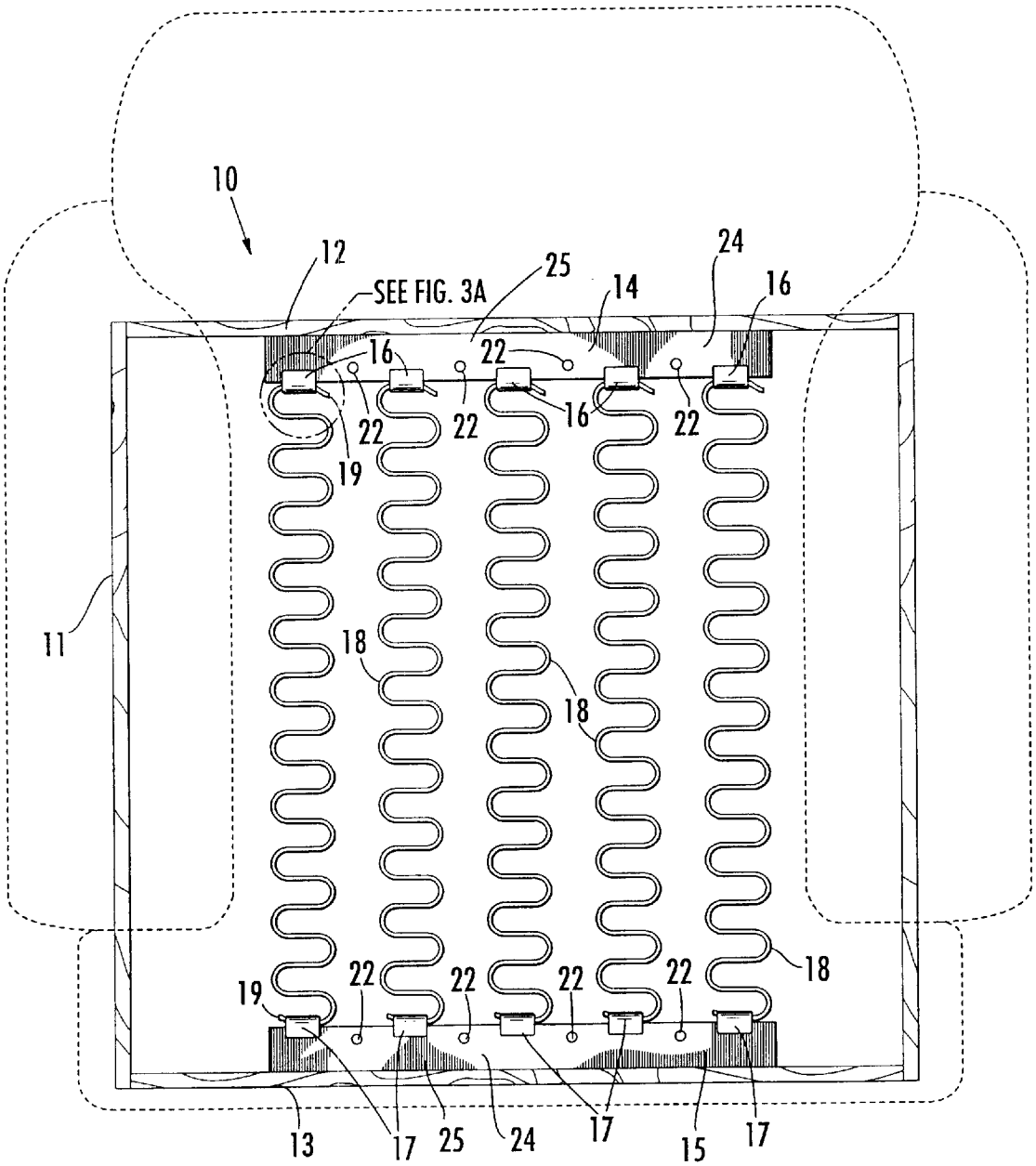
Figure 3A:
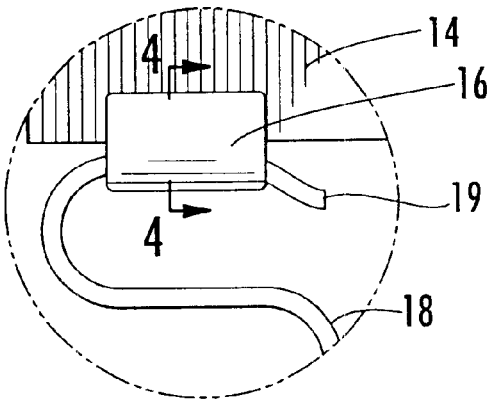
Figure 4:
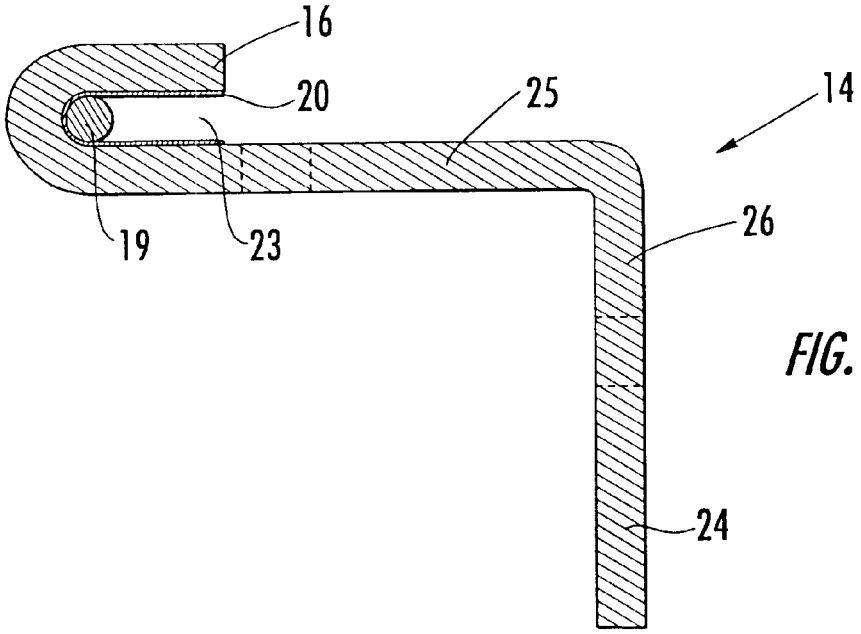

Having thus described the invention in general terms, reference will now be made to the accompanying drawings, which are not necessarily drawn to scale, and wherein:

FIG. 1 is a perspective view of a rail clip of the present invention;

FIG. 2 is a plan view of the rail clip in FIG. 1;

FIG. 3 is a plan view of a seat base including a pair of the rail clips of FIG. 1 installed in the seat base;

FIG. 3A is an enlarged view of a spring end engaged in a hook of one of the rail clips from FIG. 3; and FIG. 4 is a cross-sectional view of the spring end engaged in the hook from FIG. 3A.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention includes a rail clip 14 for seat bases as shown in FIG. 1. The rail clip 14 includes a row of integrated hooks 16 formed from tabs extending from, and spaced along, one edge of an elongated, angled body 24. The body 24 comprises a generally planar hoiizontal leg 25 and a generally planar vertical leg 26. The hooks 16 are formed along a free edge of the horizontal leg 25, i.e., the opposite edge from that to which the vertical leg 26 is joined. The vertical leg 26 includes holes 21 for fasteners, and the horizontal leg 25 likewise includes holes 22 for fasteners. Each elongate rail and the hooks 16 and 17 thereon comprise a monolithic structure formed from a single piece of material. The rail clip 14 along with a second rail clip 15, a frame 11 and a plurality of springs 18 form a seat base 10 as shown in FIG. 3. The first rail clip 14 is attached to a first frame member 12 of the frame it using wood screws, nails or other fastening devices inserted through the holes 21 and/or 22 defined in the body 24. Similarly, the second elongate rail clip 15 is attached to the second frame member 13 so that the rail hooks 16 on the first frame member are aligned with a row of rail hooks 17 on the second frame member 13. The spaced distance between the first frame member 12 and the second frame member 13 defines a seating area upon which a sofa cushion (not shown) or other similar seating material is placed for the seating comfort of the seat user. The seating area is spanned by the plurality of springs 18 that are connected between matching pairs of rail hooks 16 and 17 on rail clips 14 and 15. The springs 18 are attached so that they are stretched in tension between the opposing first and second rail clips 14 and 15, such that a resilient structure is formed for supporting the furniture seat.

As shown in FIGS. 1 and 2, the elongate rail clip 14 is constructed by first notching the free edge of the horizontal leg 25 of the rail such that a plurality of tabs extend therefrom. The tabs are then punched, rolled or pressed into a hook shape to construct the row of hooks 16 for receiving the springs 18. The first and second rows of holes 21 and 22 for fasteners can be drilled or punched into the L-shaped rail member 14, separately, or during the same manufacturing process. Forming the rail hooks 16 from a single piece of material is advantageous in that the process is easily performed while at the same time the hooks have additional strength and improved durability compared with conventional, individually attached hooks. The row of hooks 16 could also be formed on elongated rails of other shapes, such as a flat sheet stock, but the angled shape of the body 24 is preferred due to its rigidity under bending loads and its ease of manufacture.

As shown in FIG. 3, the first and second elongate rail clips 14 and 15 are attached to vertical surfaces of the first and second frame members 12 and 13, respectively, using the fasteners in holes 21 in the vertical leg of the L-shaped body 24. The rail can also be fastened to a horizontal surface via holes 22, or to a vertical surface via holes 21, or both horizontal and vertical surfaces using both sets of holes. Preferably, the hooks 16 of the first rail clip 14 are aligned across the seating area with the second hooks 17 of the second rail clip 15. The hooks 16 and 17, and hence the springs 18, preferably are spaced at regular intervals so as to uniformly support the furniture seat. The provision of the hooks 16 and 17 as integral parts of the rail clips is also advantageous in that alignment of the rail clips themselves aligns the rail hooks into evenly spaced, matched pairs. This is an improvement over conventional designs which use individually attached hooks where each individually attached hook must be spaced a proper distance from adjacent a hook and must also be matched up with a hook on the opposing side of the seat base.

Although the seat base 10 shown in FIG. 3 is the seat base for a sofa chair, the size and dimensions of the seat base can be configured for use in a range of furniture types such as a full-length couch, a recliner or a loveseat. The frame 11 of seat base 10 is shown in FIG. 3 as a wood frame but could also comprise a range of other materials, such as plastic or metal, to which the rail clips 14 and 15 can be firmly attached for the placement of the springs 18.

In other embodiments, it is possible to have the elongate rail clips 14, 15 form two sides of a generally rectangular metal frame. Thus, the ends of the rail clips can have a second pair of opposing members joined thereto. In this case, the metal frame may serve the strength-providing function of the wood frame 11 of FIG. 3. Wood members may also be included in the frame construction, if desired. Wood can be used to promote the attachment of cloth coverings to the seat using staples. The embodiment shown in FIG. 3 also reduces the amount of wood needed to construct the frame 11 because the attachment of each elongate rail clip 14, 15 to its respective frame member 12, 13 helps to stiffen the frame members.

As shown in FIGS. 3A and 4, the rail hooks 16, 17 are configured to firmly receive the ends 19 of the springs 18. The hooks 16, 17 extend upwards with respect to the bottom of the seat base 10 and back along the body 24 to define a long receiving slot 23 with respect to the body. The upward extending configuration of the hooks 16 and 17 allows them to be placed in the seat base 10 so that, once installed, the springs 18 pull inward and downward during loading, which minimizes the tendency of the spring ends 19 to slip free of their respective receiving slots 23.

The depth and width of the receiving slots 23 are configured to firmly hold spring ends 19, as shown best in FIG. 4. Each of the receiving slots 23 is of sufficient depth (i.e., several times the diameter of the spring wire) that some permanent elongation of the springs 18 can be tolerated and yet the springs 18 will not slip free of the receiving slots when unloaded. The receiving slot width aids in this task by being matched to the diameter of the spring 18 wire which allows the spring ends 19 to be press fit therein. A noise suppression material 20 such as tape, cloth or plastic can be used to line the receiving slot 23 at the interface formed by the spring ends 19 and the receiving slot 23. The noise suppression material 20 is preferably a tape which is sticky on one side and adheres tightly to the receiving slot 23, making it unlikely to wear or dislodge over time. The noise suppression material 20 has the advantage of reducing or eliminating squeaking noises that occur during loading and unloading of the seat base 10 which induces movement of the spring ends 19 relative to the receiving slot 23.

During assembly of the seat base 10, a worker inserts the elongate rail 14 into the pre-assembled frame 11 and abuts one or both of the legs 25, 26 of the rail clip 14 against a surface of a frame member. In the illustrated embodiment, the vertical leg 26 is placed against a vertical surface of the frame member 12. The worker then inserts nails, screws or other attachment devices through each of the holes 21 and into the wooden frame member 12, thereby firmly attaching the first elongate rail clip 14 to the frame member 12. The worker then positions the second elongate rail clip 15 against the second frame member 13 so that the first rail's hooks 16 are aligned with, and spaced across from, the second rail hooks 17. Similar to the first elongate rail clip 14, screws, nails or other fixation devices are inserted through the holes 21 of the second elongate rail clip 15. The sinuous metal springs 18 (also sometimes referred to as "stretchers") are then elastically extended over matching pairs of the rail hooks 16 and 17 so that the spring ends 19 are firmly inserted into the receiving slots 23. This process is repeated for each spring 18 of the seat base 10 until all of the hooks 16 and 17 are connected by the springs 18. In an assembly step not shown herein, a cover of cloth or other material is typically attached using staples to the top edge of the frame 11 to cover the rail clips 14, 15 and the springs 18. Additional rigidity can be imparted to the seat base 10 by the insertion of a cross-brace member (not shown) that attaches to the opposing rail clips 14, 15. The cross-brace member inserts into a hole defined by two hooks adjacently formed on one of the rails.

The seat base 10 and rail clip 14, 15 of the present invention have several advantages. Less assembly time is required for the seat base because the hooks do not have to be individually inserted or affixed to the frame. Less assembly time is required for each rail clip because the hooks do not have to be affixed to the body 24 of the rail clip. Another advantage is that the monolithic construction of the rail clip retains the greater strength and rigidity of a single, continuous piece of metal. Attachment of the monolithic rail clips 14, 15 to the wood frame 11 stiffens the wood frame which reduces the amount of wood that must be used in the seat base 10 for the seat base. The integral construction of the hooks 16, 17 strengthens the hooks and eliminates the potential for the hooks to pop out from the body 24 of the rail clip 14, 15, even when the seat base 10 is picked up from below putting pressure on the springs in an upward direction. Also, the insertion of the spring ends 19 in their respective receiving slots 23 in a press-fit arrangement reduces the likelihood that the spring ends will come undone from the hooks 16, 17 during repetitive loading and unloading of the seat base.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A seat base for flexibly supporting a furniture seat, said seat base comprising:

a frame including opposing first and second frame members that are spaced apart;

a first elongate rail attached to the first frame member and a second elongate rail attached to the second frame member, each of said rails having a horizontal leg extending inwardly towards the horizontal leg of the other elongate rail;

a plurality of integrated hooks formed on and spaced apart along each of the elongate rails and extending inwards from an inwardly free edge of the horizontal leg; and a plurality of springs each having a first end attached to one of the integrated hooks on the first elongate rail and a second end attached to one of the integrated hooks on the second elongate rail, such that the springs stretch between the opposing first and second member to define a resilient structure for supporting the furniture seat, and wherein each of the elongate rails and the hooks formed integrally as monolithic structure.

2. The seat base according to claim 1, wherein the plurality of integrated hooks are spaced at intervals along each of the elongate rails such that the attached springs are spaced at equidistant intervals.

3. The seat base according to claim 1, further comprising a noise suppressing material applied to spring-engaging surfaces of each of the integrated hooks.

4. The seat base according to claim 3, wherein the noise-suppressing material comprises a tape.

5. The seat base according to claim 1, wherein the plurality of integrated hooks and the elongate rail are integrally formed from a single strip of metal, the hooks being initially formed as tabs that are subsequently bent into hook shapes.

6. The seat base according to claim 1, wherein each of the hooks defines a spring-receiving width sized with respect to the springs so as to provide a press fit therebetween.

7. The seat base according to claim 1, wherein each of said rails includes a vertical leg that intersects the horizontal leg.

* * * * *

UNITED STATES PATENT AND TRADEMARK OFFICE

CERTIFICATE OF CORRECTION

PATENT NO. : 6,616,239 B2
DATED : September 9, 2003
INVENTOR(S) : Guillot

It is certified that error appears in the above-identified patent and that said Letters Patent is hereby corrected as shown below:

Column 3,
Line 21, “hoiizontal” should read -- horizontal --;
Line 32, “frame it” should read -- frame 11 --.

Column 6,
Line 27, “member” should read -- members --;
Line 30, last line of claim 1, after “as” insert -- a --.

Signed and Sealed this

Twenty-seventh Day of January, 2004

JON W. DUDAS
*Acting Director of the United States Patent and Trademark Office*